United States Patent [19]

Massey

[11] 3,965,960

[45] June 29, 1976

[54] RETRACTABLE SHOWER SHADE WITH ADJUSTABLE EXTENSIBILITY

[76] Inventor: Peyton L. Massey, 12221 Wilshire Blvd., Los Angeles, Calif. 90025

[22] Filed: Sept. 16, 1974

[21] Appl. No.: 506,262

[52] U.S. Cl. ..... 160/295; 160/11; 160/23 R

[51] Int. Cl.[2] ..... E06B 9/208

[58] Field of Search ..... 160/23, 11, 291, 292, 160/293, 294, 295, 302, 303, 238, 290

[56] References Cited

UNITED STATES PATENTS

| | | | |
|---|---|---|---|
| 1,786,512 | 12/1930 | Whitworth | 160/295 |
| 2,678,094 | 5/1954 | Sargent | 160/295 |
| 2,818,918 | 1/1958 | Lohr | 160/23 R |
| 2,840,827 | 7/1958 | Calvano | 160/11 X |

*Primary Examiner*—Philip C. Kannan

[57] ABSTRACT

A practical and safe shower shade that is retractable for storage and extensible for use, and embodied in a housing that is anchored by opposed plates to the opposite stiles of a stall or the like, the retractile force and the extensibility being adjustable upon installation, and manual control being provided for release of the shade for its retraction into the housing for storage. The shade per se, the supporting roller and the housing elements are formed to a dimension (nominal or specified) to accomodate the stall opening, while the mounting plates, retraction means and extension limiting means remain the same for all installations.

10 Claims, 10 Drawing Figures

FIG. 1.
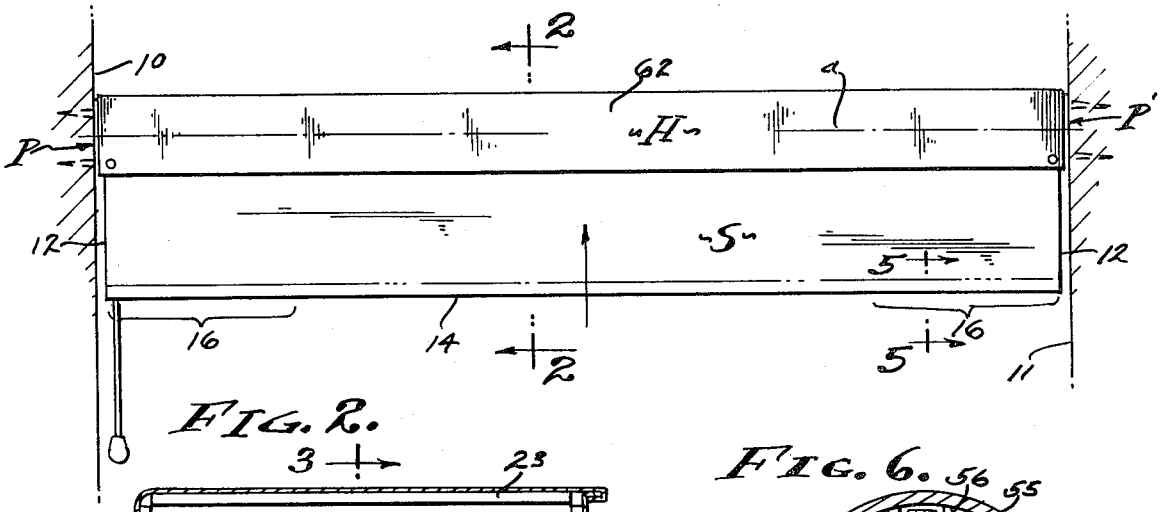
FIG. 2.
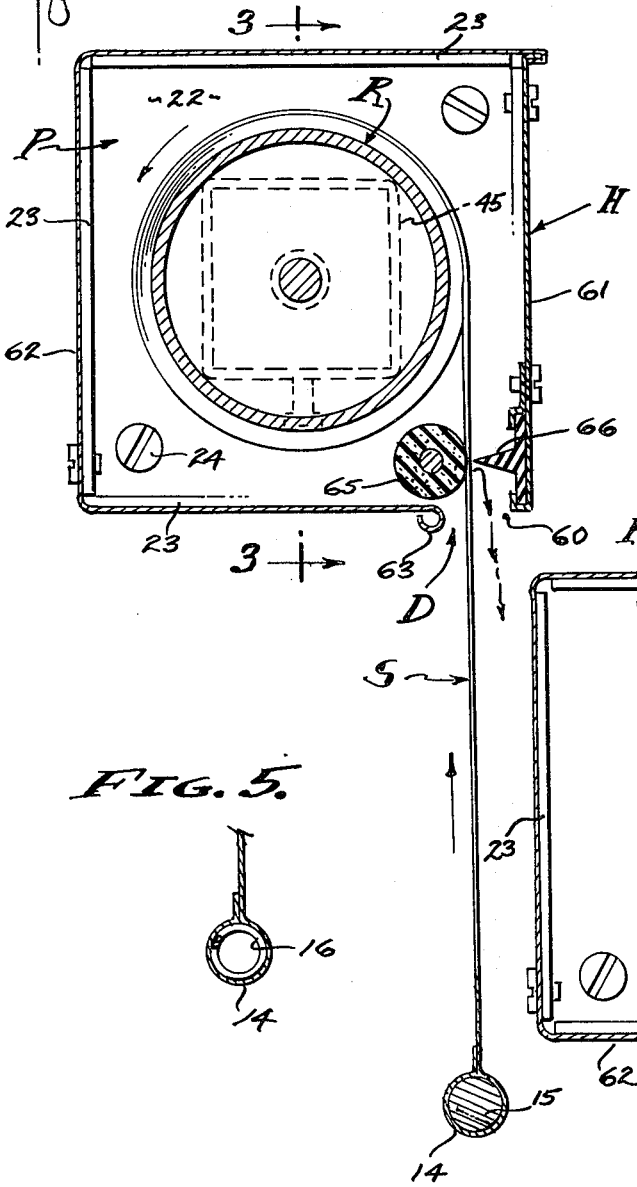
FIG. 6.
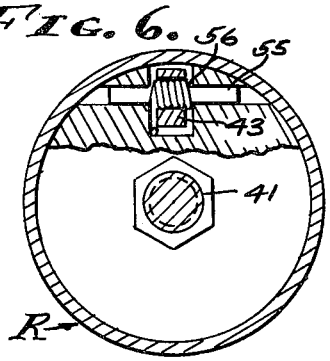
FIG. 4.
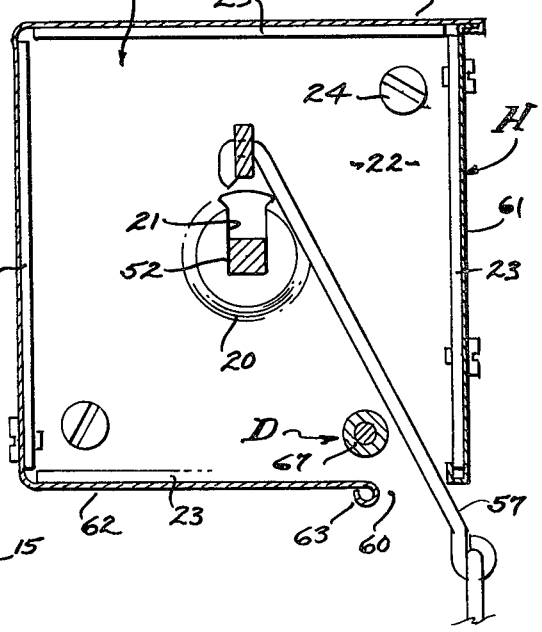
FIG. 5.

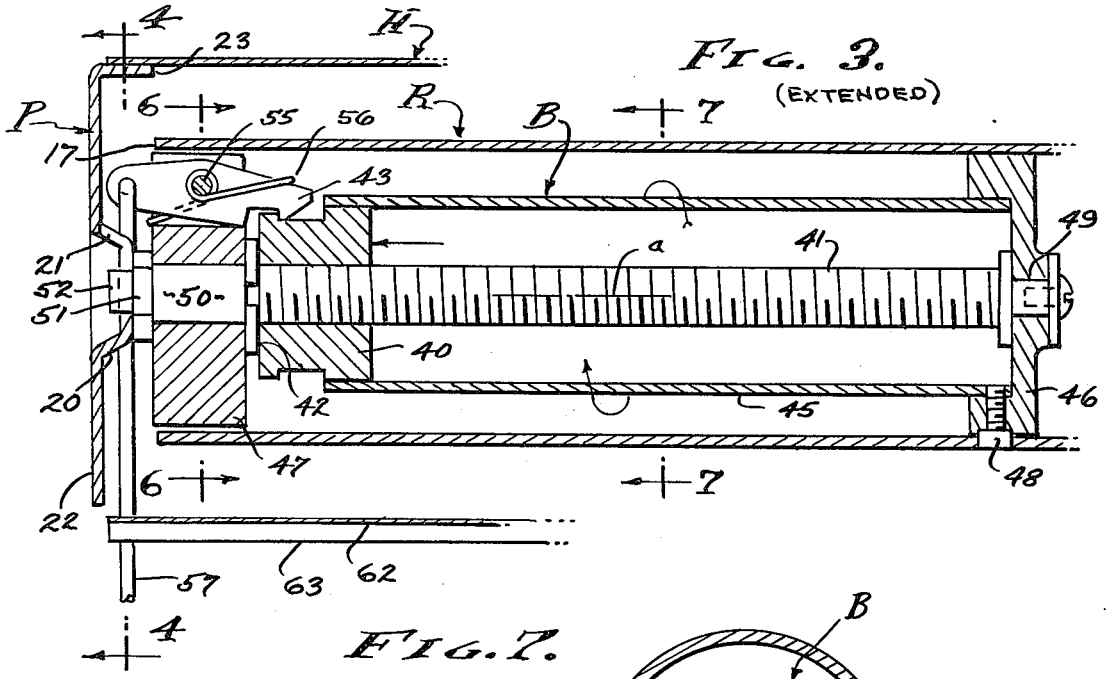
FIG. 3.
(EXTENDED)
FIG. 7.
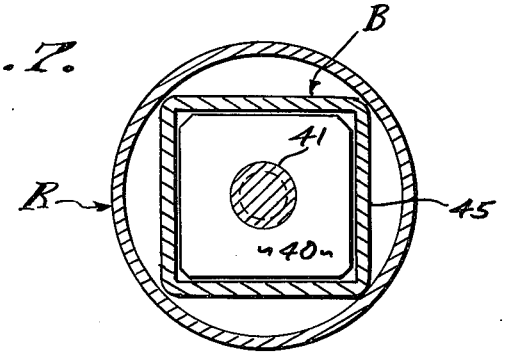
FIG. 8.
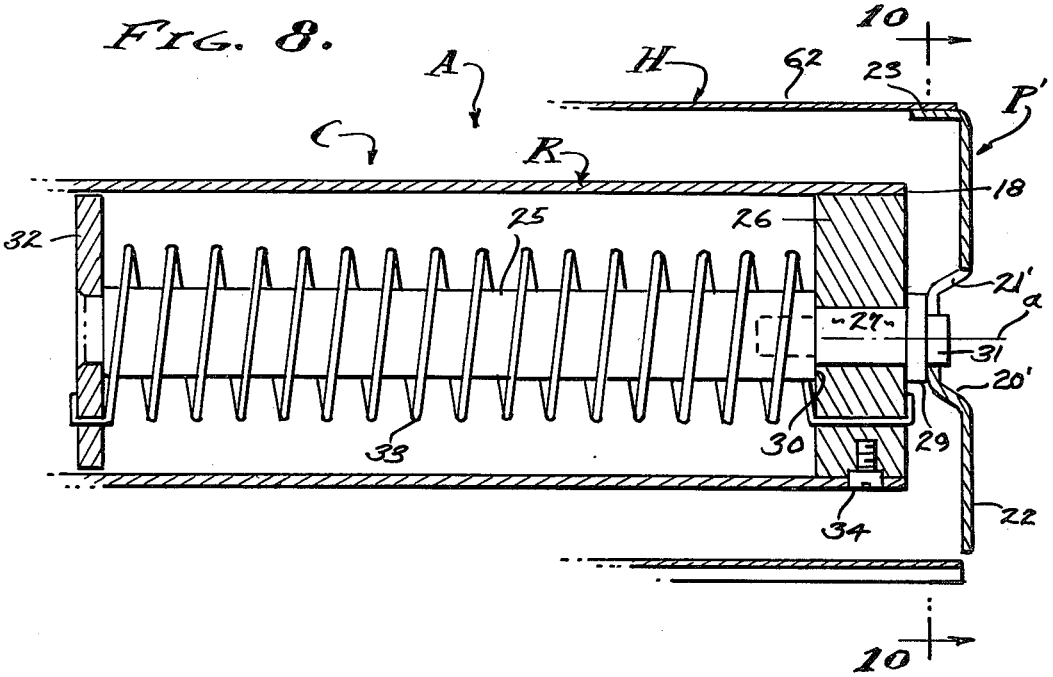

(RETRACTED)

RETRACTABLE SHOWER SHADE WITH ADJUSTABLE EXTENSIBILITY

BACKGROUND

Enclosure of a shower when in use is a problem that has involved practicality balanced against danger. Curtains have been hung to draw opened and closed along a supporting rod, and glass doors (dangerously breakable) have been pivoted and hung so as to slide between opened and closed positions. Both curtains and doors have been space consuming, they often remain wet, and neither has all of the desired attributes for practicality and safety. Curtains that have been hung so as to enclose tubs and showers and/or stalls, ten to billow and contact the body of the bather and to stick or cling to the bather. Further, curtains tend to remain wetted and become dank with mold or mildew. Glass doors have been quite dangerous even when reinforced, and they are heavy and require the constant effort of cleaning. Shower enclosures of the curtain and door type are usually made semi transparent and span the stall opening so as to afford privacy and to confine the shower spray, and to this end shower curtains are made oversized and glass doors are framed with seals. It is an object of this invention to provide the advantages of the aforementioned shower curtains and shower doors, in a retractable shower shade that is not only practical but inherently safe.

The shower shade herein disclosed is a practical replacement of a curtain or a glass door, having the advantages of both but not the objectionable features of either. That is, the shade of the present invention does not billow and need not be made oversized as is the usual curtain; and it is not fragile or breakable as is a glass door. With the present invention, a relatively heavy plastic sheet is closely fitted within the width of the stall opening and weighted so as to depend in a vertically disposed closure plane when in use. A feature of this invention is the adjustable restriction for the downward extension of the shade which is controllably retractable into a protective housing. It is an object of this invention to provide the aforementioned features in an adaptable unit of construction that can be readily applied to various stall widths and heights, all as circumstances require. The internal components of the unit remain the same for various dimensional requirements, and the side edges of the shade are closely juxtaposed to the stiles of the shower stall while the lower margin conforms to the contours of the tub or shower pan, as the case may be. .

It is an object of this invention to provide hardware of permanent character that is easily mounted. The shade element retracts onto and depends from a roller in which means is accomodated for retraction and for adjustably limited extension. The mountings for the roller are combined with a housing which carries wiper means that strips water from the inside wetted surface when the shade travels up or down. The housing maintains alignment of the roller when fastened to the opposite end plates which establish anchors for the retraction means and extension limiting means respectively.

DRAWINGS

The various objects and features of this invention will be fully understood from the following detailed description of the typical preferred form and application thereof, throughout which decription reference is made to the accompanying drawings, in which:

FIG. 1 is an elevational view of the shower shade adapted to the opposite stiles of a shower stall.

FIG. 2 is an enlarged transverse sectional view taken as indicated by line 2—2 on FIG. 1.

FIG. 3 is a detailed sectional view of the extension limiting means (extended) at one end of the unit and taken as indicated by line 3—3 on FIG. 2.

FIG. 4 is a transverse sectional view taken as indicated by line 4—4 on FIG. 3.

FIG. 5 is a fragmentary view taken as indicated by line 5—5 on FIG. 1.

FIGS. 6 and 7 are transverse sectional views taken as indicated by lines 6—6 and 7—7 on FIG. 3.

FIG. 8 is a detailed sectional view of the retraction means at the other end of the unit from FIG. 3.

Figure 9:
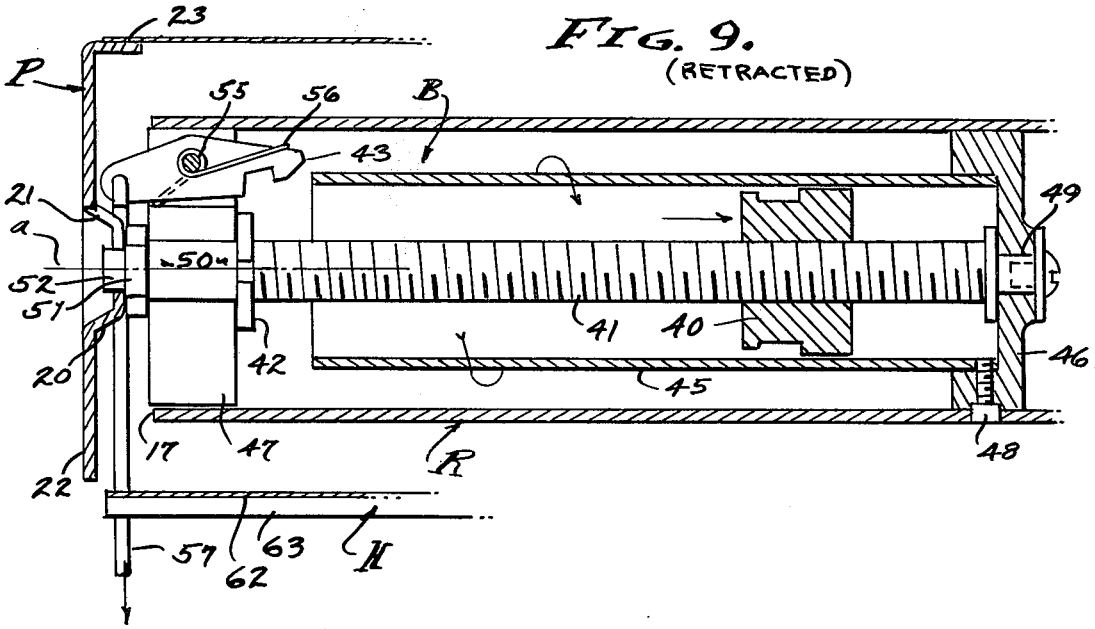
Figure 10:
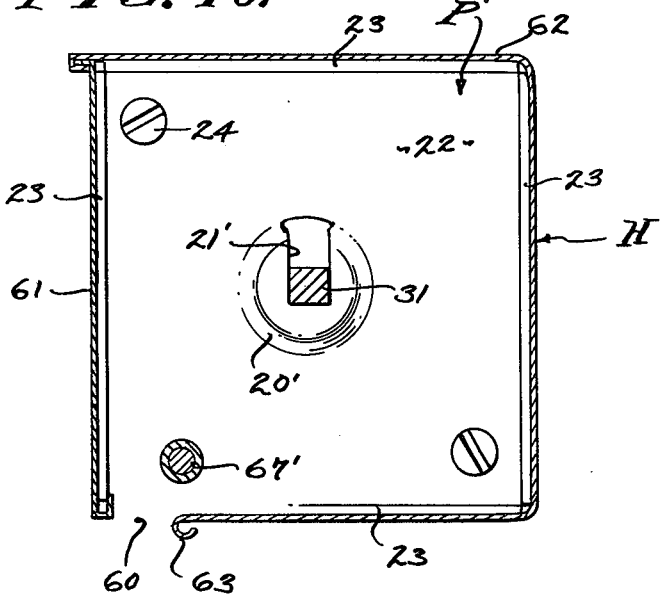

FIG. 9 is a view similar to FIG. 3 showing the mechanism released so as to permit retraction of the shade, and FIG. 10 is a transverse sectional view similar to FIG. 4 showing the other end of the unit as indicated by line 10—10 on FIG. 8.

Referring now to the drawings, FIG. 1 illustrates the opposed stiles 10 and 11 of a stall shower or like wall situation that exists at the opposite ends of a bath tub or the like. The unit of the present invention is shown installed between the stiles of the stall opening, the width of which varies within a practical range so that nominal sizes or widths can be predetermined. For example, standard tub lengths will require certain width distances between stiles in each instance, and from these standard dimensions nominal sizes are determined for the width of the shade S, supporting roller R and housing H. It is a feature of this invention that the edges 12 of the shade S be closely juxtaposed to the opposed faces of the stiles 10 and 11, thereby confining the shower spray to remain within the stall. As shown, the opposed stile faces are vertically disposed parallel faces to which plates P and P′ are affixed in horizontal alignment on an axis *a*.

The shower shade as a unit involves generally, the shade S carried upon a roller R journaled upon the opposite anchor plates P and P′ by means of retraction means A and extension limiting means B, there being releasable lock means C to hold the shade extended. As will be seen from the following description, the unit is assembled in position between the stile faces 10 and 11; first by affixing the plates P and P′ to the desired height position for placement of the axis *a;* secondly by adjustably installing the rollers R that houses the means A and B; and thirdly by enclosing the installation with the housing H. A feature of the unit is the shade wiping means D that strips water from the inside surface of the shade.

The shade S is a sheet of polyether plastic or the like, a flexible and pliant rectangle of substantial thickness, for example 0.020 – 0.030 inch thick. The uppermost margin of the sheet is fastened to the roller R, while the opposite side edges 12 are juxtaposed closely to the faces of the stiles 10 and 11 respectively. The lower margin of the sheet is folded back and secured to form a horizontally disposed sock 14 in which there is centered a weight in the form of a bar 15. As best illustrated in FIG. 1 and the cross section of FIG. 5, a flexible spring coil 16 occupies each side margin of the bottom portion of the shade; thereby to conform to the shape of a basin or tub into which the shade depends.

As shown, the spring coil 16 is of the same diameter as the bar 15 so as to form a continuous cross section within the sock 14.

The roller R is a tube of metal such as aluminum or the like, rigid and of substantial diameter for reeling the shade thereon to be stored. The roller is a right cylinder open at its ends to receive the means A and B respectively. In practice, the open roller ends 17 and 18 are normal to the axis *a* and are juxtaposed to the faces of the stiles 10 and 11 the same as the edges 12 of the shade S. That is, the roller R is the same length as the width of the shade S.

The mounting plates P and P′ are right and left mountings that provide boss-like hangers 20 and 20′ slotted at 21 and 21′ to receive the means A and B which are held in position by means of gravity. The plates are preferably sheet metal stampings or the like, having a base 22 and top and front and back flanges 23. The base 22 is planar and engages flat against the face of the stile, there being screw fasteners 24 projecting therethrough and into the stile so as to affix the plate in position. The boss-like hangers 20 and 20′ project from the base and into centering engagement with the roller R and/or the means A and B which journal the same. The slots 21 and 21′ open upwardly with opposing sides to secure the flatened trunnions of the means A and B respectively.

The retraction means A is provided to reel the shade S onto the roller R in the direction of the arrows in FIG. 2, by forcibly revolving the roller R counterclockwise when viewed as shown in said figure. As shown in FIG. 8, the means A is a spring means with an anchored stem 25 projecting into the open end of the roller and with a drive hub 26 journaled on a trunnion 27 anchored in the boss-like hanger 20′. The trunnion 27 has a bearing surface upon which the hub 26 is free to turn between a spacer 29 that separates the hub from the hanger, and a shoulder 30 formed by the stem 25. The trunnion is adjustable and held against rotation by means of a polygonal plug 31 that drops into selected rotative positions in the hanger slot. The stem 25 is of substantial length and is stabalized by a disc 32 fixed to its innermost end. And, between the disc 32 and hub 26 there is a helical coil spring 33 that is tensioned as required in order to rotate and apply the desired lift to the shade S by reeling the same onto said roller. The hub 26 is secured to the tube of the roller by screw fasteners 34 or the like, as shown.

Referring now to the extension limiting means B and the releasable lock means C combined therewith, the logic of these cooperative means is the holding of the adjustable extensibility and the manual release thereof so as to permit retraction of the shade onto the roller for storage. Essentially, the idea of means involves a determinitive number of turns of the roller R for the fully retracted position to the fully extended position of the shade S; and this is accomplished by a traveling member in the form of a nut 40 that feeds longitudinally of the roller tube upon an adjustably rotatable feed screw 41 and into engagement with a stop 42 where it is releasably engaged by a latch 43 of means C. The extension limiting means B is provided to adjustably restrict the lowering of shade S from roller R, and accordingly limits the number of turns that the roller will encure, and to this end the nut 40 is initially threaded away from the stop 42 the desired number of turns to satisfy each installation.

In accordance with this invention, the nut 40 revolves with the roller R and is slideably carried within a drive tube 45 independent of the roller R and inserted therein through the open end, as best illustrated in FIGS. 3 and 9. The feed screw is held stationary and is of substantial length, being stabilized at its inner and outer ends of a bearing disc 46 and a hub 47 respectively. The disc 46 is secured to the drive tube 45 and thereby to the roller tube by screw fasteners 48 or the like as shown, there being a pilot bearing 49 rotatably securing the end of the feed screw 41 to the drive disc. The hub 47 is a bearing hub upon which the roller R revolves and held by a snap-ring stop 42 against which the nut 40 comes to a halt. The outermost end portion of the feed screw forms a trunnion 50 upon which the hub 47 is fixed, the terminal end 52 of the screw member being polygonal, preferably four sided, so as to have four rotatably adjustable positions in the hanger slot 21. It will be seen that the number of roller turns will be limited by the number of turns that the nut 40 is initially retracted from the stop 42. The feed screw is free to turn in hub 47 for one quarter turn adjustments of end 52, and it is locked in the selected rotative position by a nut 51.

In accordance with this invention the releasable latch means C is provided to hold the shade extended when the nut 40 is against the stop 42. To this end the latch 43 is provided in the form of a sear that rocks on a pivot 55 to catch a flange on the nut 40, and normally biased into engagement therewith by a spring 56 upon which the sear revolves as is shown in FIG. 6. A pull rod 57 depends from the rocking sear so as to lift and release the catch when so desired, thereby permitting the nut 42 to run free until the shade is fully retracted.

The aforementioned parts and elements are assembled and installed as shown and described, and they are totally enclosed within the housing H with a slot 60 through which the shade S is free to extend and retract. As shown, a rear panel 61 closes the back side of the unit while a U-shaped panel 62 hooks at its upper rear margin to the panel 61 and has a lower lip 63 spaced from the lower edge of panel 61. In accordance with the invention the wiper means D is installed at this opening and which comprises a pressure roller 65 and a blade 66 and between which the shade S is moved in a vertically disposed plane. The roll 65 is horizontally disposed and is depressible and free to rotate on bearings 67 and 67′ provided in the end plates P and P′ respectively. The blade 66 is coextensive with the roll and is a horizontally disposed knife of elastomeric material that has pressured engagement with the shade surface and bends thereto responsive to the direction of upward or downward movement of the shade, as the case may be.

From the foregoing it will be seen that I have provided a simple and practical shower shade that is inherently safe to use, a shade which is automatically wiped clean of water during its movement either upward or downward, and a shade which as an adjustable limit of extension. In order to operate the shade to its fully extended position the weighted bar is simply drawn downward until the latch engages the traveling nut. Adjustment of extension is made by removing the terminal end 52 of screw 40 from the slot 21, and by rotating the screw to position nut 40 as may be required. Likewise, adjustment of retraction means A is made by removing the plug 31 from slot 21′, and by rotating stem 25 to tension spring 33 as may be required. When it is desired to release the shade for storage it is a simple matter to operate the pull rod, whereupon the retraction means operates to withdraw the shade to its stored position reeled upon the roller. Accessibility to the roller and shade is readily attained, simply by removing the foremost U-shaped panel by removing the two screw fasteners 68.

Having described only a typical preferred form and application of my invention, I do not wish to be limited or restricted to the specific details herein set forth, but wish to reserve to myself any modifications or variations that may appear to those skilled in the art:

I claim:

1. In combination with a retractile and extensible shade of flexible sheet reeled from a roller journaled upon spaced mounting plates, a revolvably adjustable retraction means fixedly anchored to the mounting plate at one end of the roller and biasing the roller to reel the sheet thereon, a revolvably adjustable extension limiting means fixedly anchored to the mounting plate at the other end of the roller and having a stop engageable with an element positioned by turning of the roller, and a latch means releasably engaging the said element and holding it against said stop.

2. The extensible shade in combination as set forth in claim 1 wherein the extension limiting means comprises a revolvably adjustably feed screw fixedly anchored to its mounting plate and projecting into the roller, and wherein the said element releasably engaged by the latch means is a nut threaded onto the feed screw and slideable in and turned by the roller to advance to and retract from said stop.

3. The extensible shade in combination as set forth in claim 1 wherein the extension limiting means comprises a revolvably adjustable feed screw fixedly anchored to its mounting plate and projecting into the roller, means rotatably journaling the roller about said feed screw, and wherein the said element releasably engaged by the latch means is a nut threaded onto the feed screw and slideable in and turned by the roller to advance to and retract from said stop.

4. The extensible shade in combination as set forth in claim 1 wherein the extension limiting means comprises a revolvably adjustable feed screw fixedly anchored to its mounting plate and projecting into the roller, means comprising a drive tube fixed within the roller with a disc journaled on the feed screw, and wherein the said element releasably engaged by the latch means is a nut threaded onto the feed screw and slideable in and turned by the drive tube to advance to and retract from said stop.

5. In combination with a retractile and extensible shade of flexible sheet reeled from a roller journaled upon spaced mounting plates, a revolvably adjustable retraction means fixedly anchored to the mounting plate at one end of the roller and biasing the roller to reel the sheet thereon, a revolvably adjustable extension limiting means comprised of a feed screw fixedly anchored to its mounting plate and projecting through a hub carrying a stop at the end of the roller, a traveling element in the form of a nut threaded onto the feed screw and engageable with the said stop and slideable in and turned by the roller to advance to and retract from said stop, and latch means releasably engaging the said element and holding it against said stop.

6. The releasably extended shade in combination as set forth in claim 5 wherein the latch means comprises a lever pivoted through the said hub to engage the said nut element within the hub and accessible for operation at the end of the roller.

7. The releasably extended shade in combination as set forth in claim 5 wherein the latch means comprises a lever-sear pivoted on an axis transverse of the roller and feed screw axis and offset therefrom to extend through said hub to engage the said nut element within the tube and accessible for operation at the end of the roller.

8. The releasably extended shade in combination as set forth in claim 5 wherein the latch means comprises a lever pivoted through the said hub to engage the said nut element within the hub and accessible for operation at the end of the roller, and whereby the feed screw is revolvably anchored at a terminal polygonal end portion outside the end of the roller, said polygonal end portion being slideably engaged in a slot in the mounting plate therefor.

9. The releasably extended shade in combination as set forth in claim 5 wherein the latch means comprises a lever-sear pivoted on an axis transverse of the roller and feed screw axis and offset therefrom to extend through said hub to engage the said nut element within the tube and accessible for operation at the end of the roller, and wherein the feed screw is revolvably anchored at a terminal polygonal end portion outside the end of the roller, said polygonal end portion being slideably engaged in a slot in the mounting plate therefor.

10. The releasably extended shade in combination as set forth in claim 5 wherein the latch means comprises a lever-sear pivoted on an axis transverse of the roller and feed screw axis and offset therefrom to extend through said hub to engage the said nut element within the tube and accessible for operation at the end of the roller, and wherein the feed screw is revolvably anchored at a terminal polygonal end portion outside the end of the roller, the feed screw being rotatable in the said hub with lock means therefor, said polygonal end portion being slideably engaged in a slot in the mounting plate therefor.

* * * * *